US005097951A

United States Patent [19]

Pigott et al.

[11] Patent Number: 5,097,951

[45] Date of Patent: Mar. 24, 1992

[54] UNIT LOAD ASSEMBLY FOR SPOOLS

[75] Inventors: Maurice J. Pigott, Winnetka; Brandon L. Pigott; Peter S. Pigott, both of Wilmette; Schuyler F. Pigott, Arlington Heights, all of Ill.

[73] Assignee: Nucon Corporation, Northbrook, Ill.

[21] Appl. No.: 599,180

[22] Filed: Oct. 16, 1990

[51] Int. Cl.[5] ..... B65D 19/00

[52] U.S. Cl. ..... 206/386; 206/397; 206/596; 206/598; 206/600; 206/413; 206/415; 206/403; 108/55.3; 108/901

[58] Field of Search ..... 206/386, 397, 596, 598, 206/600, 413, 415, 403, 398, 385; 108/57.1, 52.1, 55.5, 55.3, 901

[56] References Cited

U.S. PATENT DOCUMENTS

| | | | |
|---|---|---|---|
| Re. 32,344 | 2/1987 | Wind | 108/53.1 |
| 2,691,499 | 10/1954 | Watts | 248/120 |
| 2,916,239 | 12/1959 | Stopps | 248/120 |
| 3,123,020 | 3/1964 | Voissem | 108/51 |
| 3,606,844 | 9/1971 | Lubker II et al. | 108/901 |
| 3,610,173 | 10/1971 | McIlwraith | 108/57 |
| 3,664,271 | 5/1972 | Wolder et al. | 108/51 |
| 3,664,272 | 5/1972 | Sanders | 108/53 |
| 3,667,403 | 6/1972 | Angelbeck, Jr. | 108/58 |
| 3,683,821 | 8/1972 | Mangold | 108/53 |
| 3,691,964 | 9/1972 | Larson et al. | 108/51 |
| 3,717,396 | 2/1973 | Dupree | 108/111 |
| 3,804,032 | 4/1974 | Baucom | 108/51 |
| 3,814,031 | 6/1974 | Fowler | 108/51 |
| 3,915,099 | 10/1975 | Wies et al. | 108/53 |
| 3,994,241 | 11/1976 | Evans | 108/53.5 |
| 4,013,021 | 3/1977 | Steinlein et al. | 108/51.1 |
| 4,051,787 | 10/1977 | Nishitani | 108/55.3 |
| 4,316,419 | 2/1982 | Cupido | 108/56.1 |
| 4,580,680 | 4/1986 | Wind | 206/600 |
| 4,597,338 | 7/1986 | Kreeger | 108/51.1 |
| 4,635,562 | 1/1987 | Kreeger | 108/55.1 |
| 4,706,576 | 11/1987 | James | 108/111 |
| 4,735,154 | 4/1988 | Hemery | 108/51.1 |
| 4,843,976 | 7/1989 | Pigott et al. | 108/56.1 |
| 4,928,827 | 5/1990 | Hara | 206/413 |
| 4,998,619 | 3/1991 | Sowa | 206/386 |

FOREIGN PATENT DOCUMENTS

| | | | |
|---|---|---|---|
| 1310898 | 3/1973 | United Kingdom | 108/902 |

*Primary Examiner*—Paul T. Sewell
*Assistant Examiner*—M. D. Patterson
*Attorney, Agent, or Firm*—Wallenstein, Wagner & Hattis, Ltd.

[57] ABSTRACT

A unit load assembly for spools (10) that can be assembled and disassembled easily and frequently is disclosed. A spool member (50) can be securely strapped (70) between two pallet assemblies (10). Each pallet assembly (10) is constructed of a pair of substantially identical frame members (11) releasably interconnected to one another by a plurality of internal coupling members (30,40). Each frame (11) includes a plurality of openings (17A, 17B) for cooperating with the internal coupling members (30,40) and a central aperture (16) for receiving a portion of the spool member (50). Each frame (11) also has perimeter side support means (15,15A) and internal support means (24,25,26) for supporting the load placed upon the assembled unit load assembly (10).

18 Claims, 3 Drawing Sheets

UNIT LOAD ASSEMBLY FOR SPOOLS

DESCRIPTION

1. Technical Field

The present invention relates generally to pallets, and more particularly, to load-bearing pallets for holding a spool member disposed therebetween in either a vertical or a horizontal position.

2. Background Prior Art

For many years, wooden pallets have been the mainstay of the material handling business. Such pallets have been economical, simple to use, and durable. However, these wooden pallets are extremely heavy and often require costly hand labor in their fabrication.

Moreover, many times pallets are used to hold spooled items or materials wound around a spindle, such as film, wire and paper. These pallets typically hold the spool in the horizontal position. Securing the spool in a horizontal position, and especially, in the vertical position, can be both difficult and dangerous because, typically, pallets are not made for holding the spool end. A section can be built up on the deck of the pallet for holding the end, but this generally interferes with the stackability of the pallet. The solution of providing an opening in the pallet will, inevitably, affect the structural strength of the pallet. Also, the cylindrical shape of the spool assembly makes it difficult to tie down to the pallet. There remains a significant need for a pallet that is capable of supporting and holding spooled items.

SUMMARY OF THE INVENTION

According to the present invention, a unit load assembly for spools or, alternatively, a spool member holding pallet assembly, has been developed that supports a spool member in either a vertical position or a horizontal position. The spool member has windings wrapped around a spindle with the spindle ends extending out beyond the edge of the windings. Specifically, the spool member is held between two pallets with each end of the spool threaded into a central aperture in each pallet. Tightened straps encircle the entire assembly of the two pallets and the spool disposed therebetween. The pallets further have forklift tine receiving slots for permitting the tines of a forklift to enter the pallet and move it.

Each pallet of the present invention is constructed of a pair of frame members or decks releasably interconnected by a plurality of coupling members or connectors. Each frame comprises an outer frame surface and an inner frame surface, a plurality of spaced connector openings and a central aperture. The connector openings and the central aperture are positioned to be vertically aligned with the connector openings and the central aperture of the interconnected frame member.

The frame members further include opposed end walls and opposed side walls. A side support structure of a second side wall with a plurality of integral posts, and an internal support structure project from and are integral with the inner frame surface. In the preferred embodiment, the second side wall and integral posts are higher than the first side wall. Also, the internal support structure includes a first longitudinal support wall and a spaced, parallel second longitudinal support wall that extend from one end of the frame to the other end of the frame. The first longitudinal support wall is connected to the second side wall. The second longitudinal support wall is connect to an arcuate support wall that is semi-circular and positioned adjacent the central aperture. The end walls have ramp sections therein that are inclined and taper inwardly from the outer frame surface to the inner surface for guiding the forklift tines.

To prevent the encircling straps from slipping on the inner frame surface, the end walls have strap channels therein. And, to prevent the encircling straps from slipping on and off the outer frame surface, the side walls and the outer frame surface have strap channels.

The load-bearing pallet of the present invention is formed by interconnecting a pair of identical frame members with a plurality of connector members that releasably couple to each frame member. The frames are first oriented so that their inner frame surfaces face each other, the end walls align with the other end walls, one first side wall aligns with the other second side wall, and one second side wall aligns with the other first side wall. The connectors are coupled to one frame member by inserting one end of each into a frame connector opening. The other end of the connectors are coupled to the other frame member. By this construction, each pallet can be assembled and disassembled easily and frequently. And, broken or damaged parts can be quickly replaced.

Other advantages and aspects of the present invention will become apparent upon reading the following description of the drawings and detailed description of the invention.

DETAILED DESCRIPTION

Figure 1:
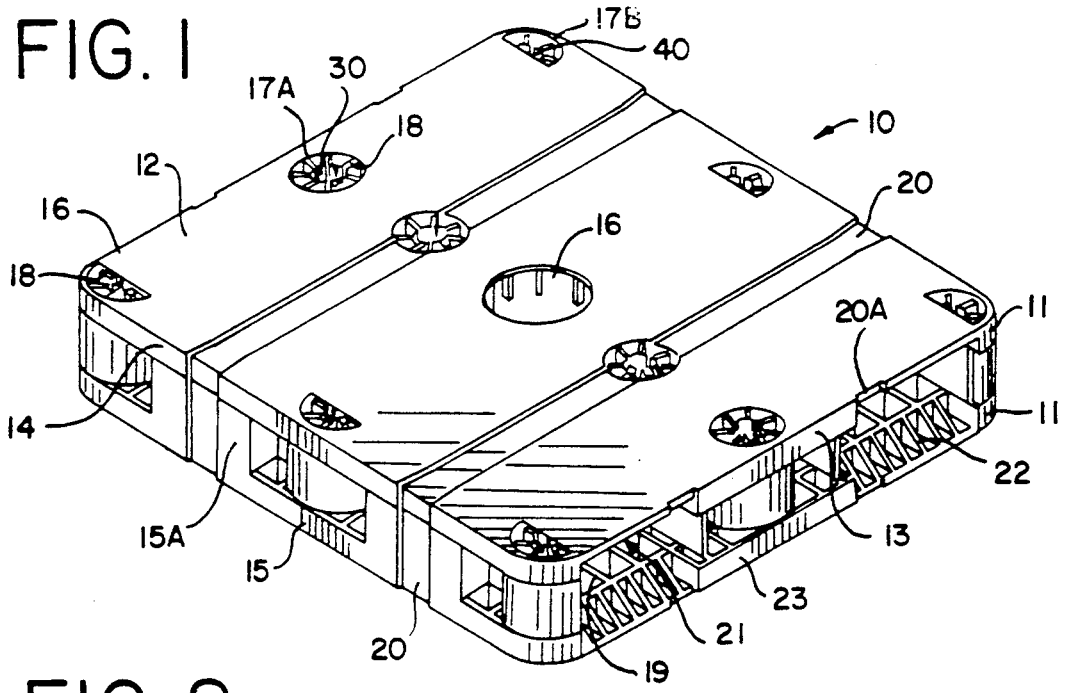
FIG. 1 is a perspective view of the unit load assembly for spools made in accordance with the teachings of the present invention.

While this invention is susceptible of embodiment in many different forms, there is shown in the drawings and will herein be described in detail a preferred embodiment of the invention. It should be understood, however, that the present disclosure is to be considered an exemplification of the principles of the invention. It is not intended to limit the broad aspect of the invention to embodiment illustrated.

FIG. 1 of the drawings shows a completely assembled unit load assembly for spools or, alternatively, a load-bearing pallet, designated by reference numeral 10, for supporting and holding a spool. The pallet 10 is formed of a pair of identical rectangular decks or frame members 11 that are interconnected by a plurality of connectors 30,40. Preferably, all parts are made out of plastic.

Figure 2:
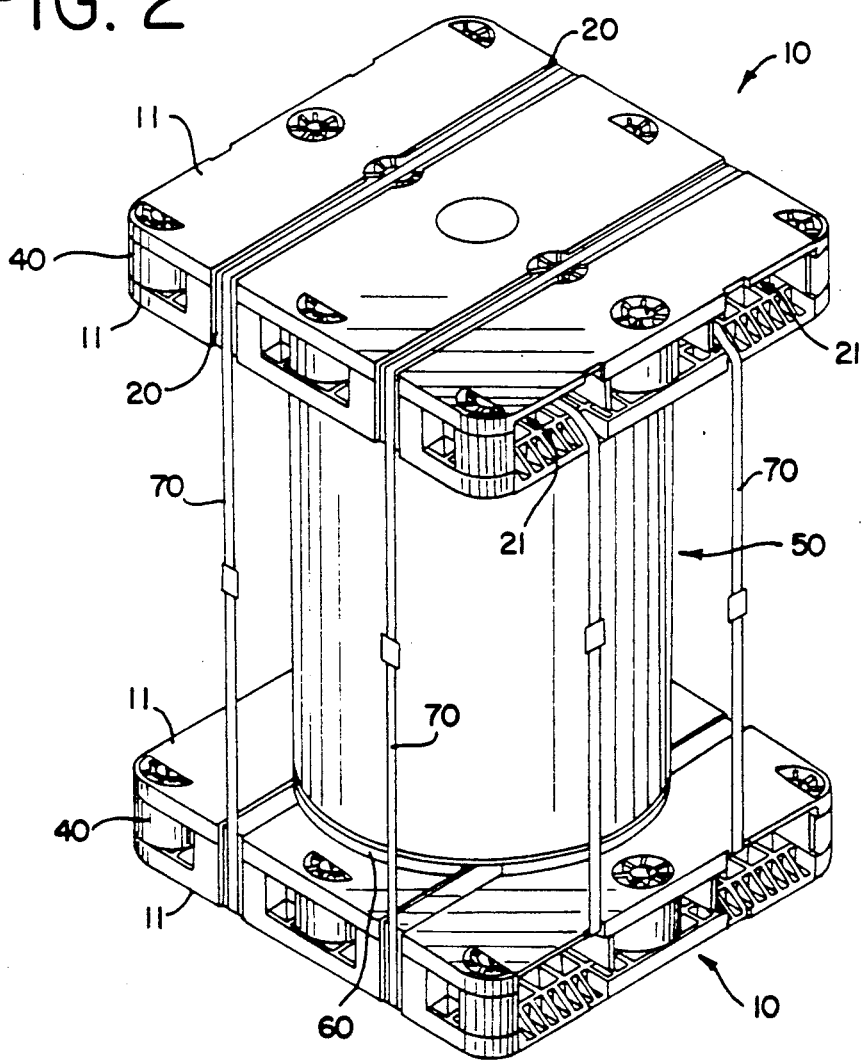
FIG. 2 is a perspective view of a pair of assembled pallets with a spool member strapped thereto and disposed therebetween.

As demonstrated in the illustration of FIG. 2 of the drawings, a spool member 50 can be securely held in a vertical position between two assembled plastic pallets 10. A spool member 50 can also be held in a horizontal position between two assembled pallets 10. The entire assembly, being the two assembled pallets 10 with the spool member 50, is strapped together with a plurality of tightly wrapped straps 70. The pallets 10 are constructed to have forklift tine receiving slots 21 when the two frame members 11 are interconnected to form the assembled pallet 10. Also, each frame 11 has strap channels 20 therein to receive the encircled straps 70 and prevent these straps 70 from slipping. The straps are placed around the assembly in such a manner so as to hold the entire assembly together without interfering with the tines of a forklift truck. Thus, a forklift truck can push its tines into the two tine receiving slots 21 formed in each assembled pallet 10 and pick up, carry, and move the supported spool 50 to a desired location.

While the pallet of the present invention is capable of holding a spool member, it is appreciated that the pallet can also be used to support other items in the same manner as other pallets commonly used in the industry.

Figure 3:
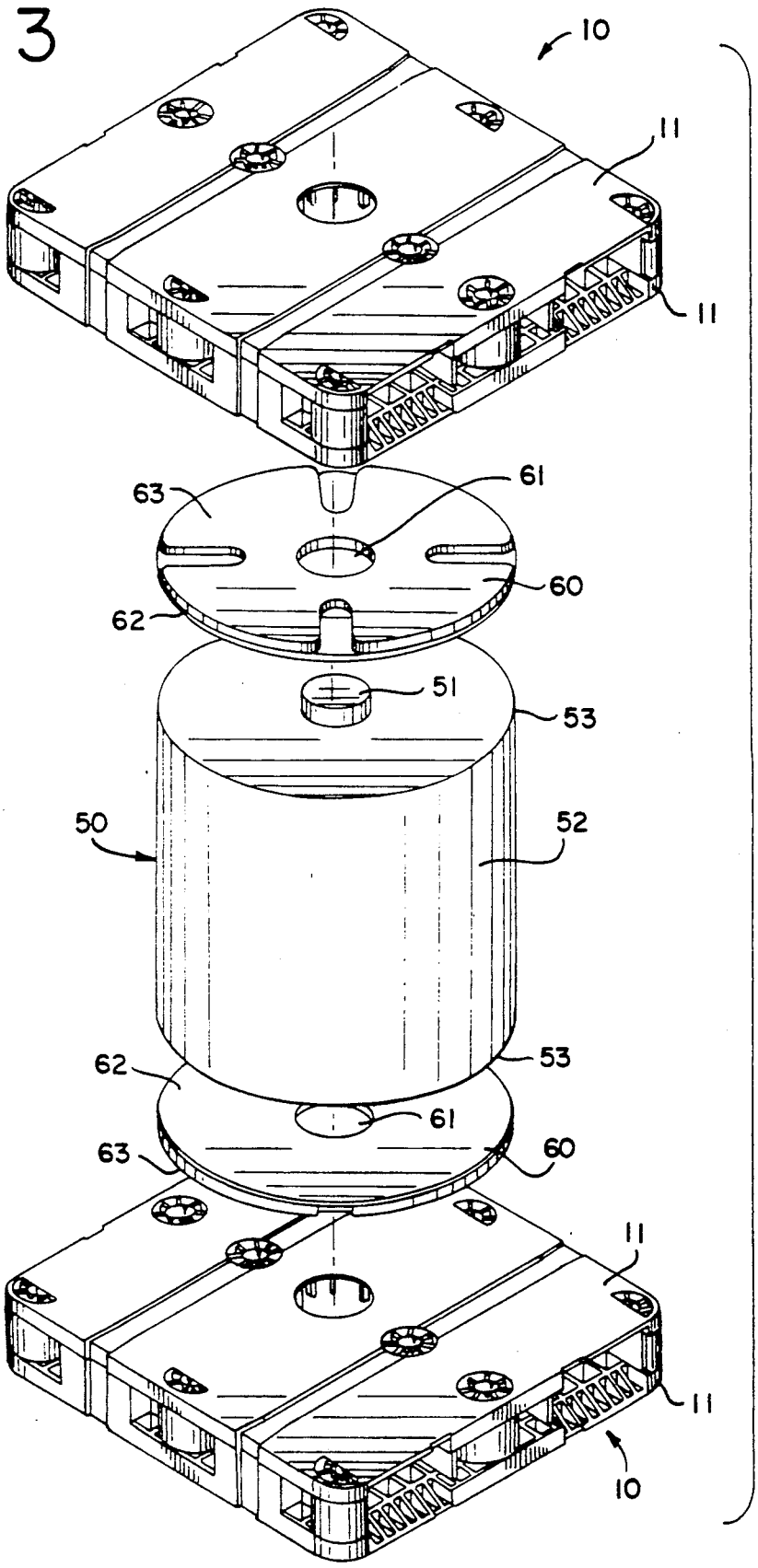
FIG. 3 is an exploded perspective view of the assembly shown in FIG. 2; and, FIG. 4 is an exploded perspective view of two unassembled frame members and two connectors, all made in accordance with the teachings of the present invention and used to construct the unit load assembly for spools shown in FIGS. 1–3.

The spool member 50 that is carried by the pallets of the present invention is shown in FIG. 3. Typically, the spool 50 has a spindle 51 which is often a solid cylindrical rod member. Windings of material 52 are wrapped around the spindle 51. Commonly wound materials are film, paper, wire, cable and fabrics. Since most often the windings of material 52 have a windings edge 53 at opposite sides, the ends of the spindle 15 project outwardly beyond the edges 52. It is a portion of each of these spindles ends 51 that is threaded into each opposed pallet assembly 10.

Figure 4:
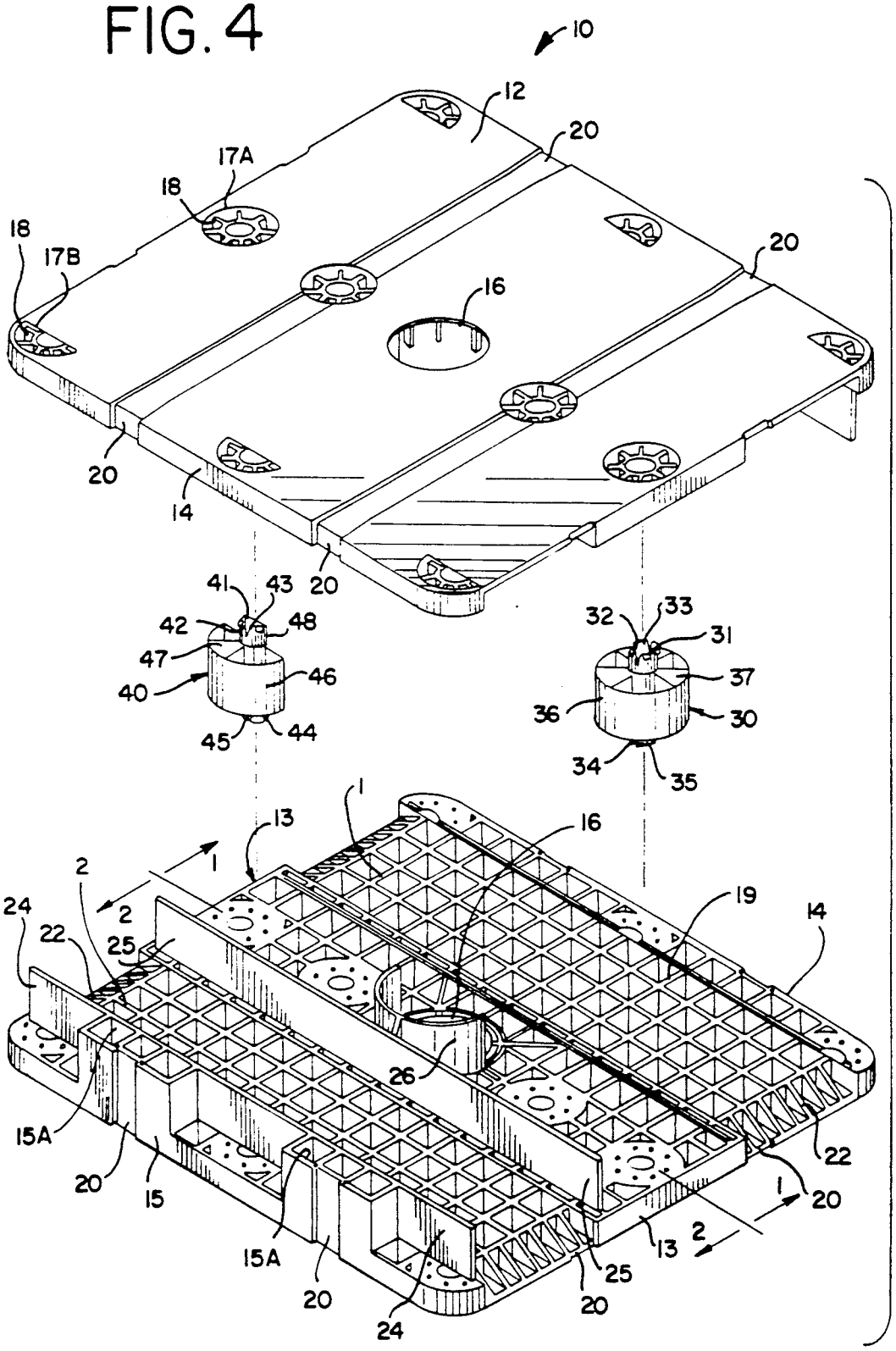

The specifics of each frame member or deck 11 and the connectors are shown in FIGS. 1 and 4 of the drawings. According to one aspect of the present invention, each frame 11 used to form a pallet 10 is substantially identical, and therefore, interchangeable. Each frame 11 includes an outer frame surface 12, an inner frame surface 19, opposed end walls 13 and opposed side walls 14,15. Specifically, there is a first side wall 14 and an opposed second side wall 15 that is higher than the first side wall 14. In the center of the frame 11, there is constructed a central aperture 16 for receiving the spindle end 51 of the spool member 50.

A plurality of connector openings 17A,17B are disposed within the frame 11 for releasably receiving and cooperating with the connectors 30,40. Each of the openings 17A,17B and the central aperture 16 are positioned so as to be vertically aligned with the openings 17A,17B and central aperture 16 of an interconnected frame member.

A plurality of connectors 30,40 cooperate with the frame members openings 17A,17B and couple the two frames 11 together. In the illustrated embodiment, three half connectors 40 are releasably coupled to the frame 11 in a row near each side of the frame 11 and four full connectors 30 are releasably coupled to the frame 11 in a centrally located row in the center of the frame 11 and equally spaced from the sides 14,15. These connectors 30,40 maintain the frame members 11 spaced from each other and are positioned so that forklift tine receiving slots 21 are formed between the connectors 30,40 and within the pallet 10. The tine receiving slots 21 extend from one end of the pallet to the other end of the pallet.

In FIG. 4, two types of connectors are shown which are used in the present assembly. These are the full connectors 30 and the half connectors 40. The specific details of the construction use, coupling and uncoupling of the full connectors 30 are disclosed in U.S. Pat. No. 4,843,976, entitled PLASTIC PALLET, which is incorporated herein by reference. Generally, each full connector 30 includes a hollow central circular core 31 that has circumferentially spaced slots 32 extending from opposite ends thereof which produce first and second sets of tangs 33,34. Each tang 33,34 is identical in construction and has a barb 35 formed adjacent a free end thereof. Each barb 35 has a flat lower surface which extends perpendicular to the axis of the core and has a tapered surface extending from the outer edge to define a ramp.

The central core 31 has a force absorbing flange (not shown) located at the center of the core and equally spaced from the opposite ends. Additionally, each tang 33,34 has an inner integral reinforcing rib (not shown). Thus, forces applied to the tangs 33,34 are transmitted by the ribs to the flange where they are dissipated.

The connector 30 also includes a large circular sleeve 36 that surrounds the core 31 and is connected thereto by radially extending spokes 37.

The half connectors 40 are similarly constructed. However, each half connector is semi-circular, rather than circular. A solid, plastic vertical wall 48 is included in the half connector 40 which has the general effect of halving a full connector 30. Each half connector 40 includes a hollow central semi-circular core 41 that has circumferentially spaced slots 42 which produce two sets of tangs 43,44. Barbs 45, like those for the full connector 30, are at the end of each tang 43,44. A semi-circular sleeve 46 surrounds the semi-circular core 41 and is connected by spokes 47.

The frame member 11 has a plurality of spaced connector openings 17A,17B which are adapted to releasably receive the tangs 33,34 of the full connectors 30 and tangs 43,44 of the half connectors 40. These openings 17A,17B are surrounded by abutments 18 that are recessed below the outer surface 12 of the frame 11. The abutments 18 are spaced and dimensioned so that the barbs 35 or 45 on the tangs 33,34 or 43,44 will snap into position.

To assemble the plastic pallet 10, the full connectors 30 and half connectors 40 are first assembled to one frame member 11 by aligning a set of tangs 33,34 or 43,44 with an opening 17A,17B and then applying an axial force which causes the ramps of the barbs 35 or 45 to deflect the tang inwardly sufficient to allow the set of tangs to pass through the openings. After the barb 35,45 has cleared the abutment surface 18, the memory characteristics of the plastic will snap the tangs back to their original condition and lock the connector to the frame 11. After all of the connectors are assembled on one frame, the second frame is positioned as shown in FIG. 4 and a force is applied to the outer surface to complete the assembly of the plastic pallet 10.

Having the frames 11 and the connectors 30,40 constructed in this manner permit their repeated and interchangeable use. The pallets 10 can thus be easily and frequently assembled and disassembled. Furthermore, broken or damaged pieces can be easily replaced.

As shown in detail in FIG. 4, each frame member 11 has two sections, a first frame section 1 and a second frame section 2. In the illustrated embodiment, each section is a half-section of the frame 11. The two sections are generally separated by the longitudinal centerline, designated as line 1-2, that bisects the end walls 13. With respect to the first section 1, the inner surface 19 is generally uniform in thickness, being the thickness of the deck 11. To save material, it is honeycombed or gridded. Also, the first side wall 14 is the thickness of the frame member 11. On the other hand, the second section 2 is not only honeycombed or gridded, but it also includes a perimeter support structure and an internal support structure that are integral with and project outwardly from the inner surface 19 of the frame.

Thus, to assemble the pallet of the present invention, the frames 11 are first positioned so that their inner frame surfaces 19 face each other and are oriented so that the first frame section 1 of one frame 11 is vertically aligned with and above the second frame section 2 and visa versa. And, the connectors 30,40 are coupled to the frame members 11 in the previously-stated manner. Consequently, when connected, the perimeter support structure and the internal support structure of each of the interconnected frames acts as the internal support structure for half of the assembled pallet 10. While it is recognized that the connectors 30,40 connecting the individual frames together can bear a load, the internal support structure of the assembled pallet permits the pallet to bear a higher, and sometimes more concentrated, load.

With respect to the second frame section 2, there is a perimeter support structure of a second side wall 15 having a plurality of integral posts 15A. Both the second side wall 15 and the integral posts 15A are integral with and project from the inner frame surface 19. These posts 15A of the second side wall 15 are higher than the first side wall 14. Included in the internal support structure is a first longitudinal support wall 24 that is disposed adjacent the posts 15A of the second side wall. The first longitudinal support wall 24 generally extends the length of the frame 11, being from one end of the frame 11 to the other end. In the preferred embodiment, this first longitudinal support wall 24 is connected to the posts 15A of the second side wall 15. The internal support structure also includes a second longitudinal support wall 25 which is spaced from and parallel to the first longitudinal support wall 24. As evident in FIG. 4, this second longitudinal support wall 25 also generally extends the length of the frame member 11. The space between the support walls 24,25 is preferably sufficient so as to permit a forklift tine therebetween. Thus, these two longitudinal walls 24,25 not only add strength to the assembled pallet 10, but also, guidance to the tine passing therein. For example, the parallel walls 24,25 act as pallet tracks or channels within which the forklift tines may pass therethrough. As a result, a forklift tine will bump against a longitudinal wall 24 or 25, rather than get caught on a connector or the spool member. Accordingly, these parallel internal longitudinal support walls 24,25 form the boundary of the forklift tine receiving slots 21.

For adding internal structural strength to the pallet 10, and especially the load placed on the assembled frame members 11 around their vertically aligned central apertures 16, an arcuate support wall 26, which is semi-circular, also projects from and is integral with each inner surface 19 of the frame member. This arcuate support wall 26, located in the second frame section 2, is positioned adjacent the second longitudinal support wall 25 on one side and the perimeter of the central aperture 16 on the other side. In the preferred embodiment, the arcuate support wall 26 is connected to the second longitudinal support wall 25. When the two frames 11 are assembled in the above-described manner to form a pallet, the two arcuate support walls 26 abut each other and form an internal circular wall or continuous cylindrical channel around the perimeter of the central aperture 16 inside the pallet. In addition to adding strength to the pallet, this internal circular wall acts as a guidance channel and prevents the improper threading of the end of the spool spindle 51 into the pallet assembly.

Consequently, when assembled, each load-bearing pallet 10 is extremely strong because the interconnected frames 11 are mated so that each end walls 13 align and cooperate with the other end walls 13, each first side wall 14 aligns and cooperates with the other second side wall 15 and posts 15A, each second side wall 15 and posts 15A aligns and cooperates with the other first side wall 14, and each second longitudinal support wall 25 and arcuate support wall 26 align and cooperate with the other inner frame surface 19. Also, the connector members 30,40 which are engagedly disposed within each of the frame member vertically aligned connector openings 17A,17B add strength to the pallet, in the manner discussed above.

Frame ramp sections 22 are further constructed in each end 13 of the frame members 11. Each such ramp 22 tapers inwardly from the frame outer frame surface 12 to the inner frame surface 19. The ramps 22 are inclined surfaces for guiding the forklift tine into the forklift tine receiving slot 21 of the assembled pallet 10. A planer section 23 of the end wall 13 is disposed between the two ramp sections 22. This planer section 23 is a vertical wall that is basically the thickness of the frame 11.

The pallet 10 of the present invention further includes strap channels 20 disposed within the outer frame surface 16, the first side wall 14, the second side wall 15 and each end wall 13. Shown in the embodiment in FIG. 2, the strap channels 20 form tracks or grooves in the frames 11 for cooperating with the straps 70. These channels 20 not only provide troughs for guiding the straps 70 into position, but also prevent the straps 70 from slipping once they are in place. Specifically, to encircle the assembly, a first set of parallel straps 70 is tightly wrapped around the pallets 10 by positioning the straps 70 in the strap channels 20 in the outer surface 16 of the deck 11, the first side wall 14, and the second wall 15 and tightening these straps 70 down by conventional means. An additional, second set of parallel straps 70, that is transverse to the first set of straps 70, is threaded through the forklift tine receiving slots 21 of one pallet assembly 10, positioned in the strap channels 20 in the end wall 13 of this assembly and similarly threaded and positioned into the opposed pallet assembly 10. Unlike the first encircling set of straps 70, this second encircling set of straps 70 contacts the inner frame surfaces 19. As a result, a spool member 50 can be securely held and safely maintained between a pairs of load-bearing pallets 10 by threading one end of the spindle 51 into the central aperture 16 of one pallet 10 of interconnected frame members 11, by threading the other end of the spindle 51 into the vertically aligned central apertures 16 of the other pallets constructed of a pair of frame members 11, and by encircling the entire assembly with tightened straps 70 that are positioned within the strap channels 20 formed into the frames 11.

Generally circular separating members 60 can be provided as washer means between the spool member 50 and each pallet assembly 10. The separating members 60, shown in FIG. 3, have a central opening 61 for permitting the spindle end 51 to pass therethrough into the pallet central aperture 16. The separating member 60 is typically composed of two materials, being a generally hard material portion 62 and a soft material portion 63. The hard material portion 62, which is positioned against the windings 52 of the spool member 50, is commonly composed of Formica®, hard plastic, metal or a hard, rigid material. The soft material portion 62, which is positioned against the frame members 11, is commonly composed of foam, rubber, felt or a soft material.

While the specific embodiments have been illustrated and described, numerous modifications come to mind without significantly departing from the spirit of the invention and the scope of protection is only limited by the scope of the accompanying Claims.

We claim:

1. A unit load assembly for holding a spool member having windings wrapped around a spindle, the spindle having ends extending out beyond the end of the windings, comprising:

a pair of frame members interconnected to one another by a plurality of internal coupling means, said internal coupling means spacing said frame members from each other, each frame member having two approximately equal side sections, opposed end walls, opposed first and second side walls, an outer frame surface and an inner frame surface, each frame member further including:

a plurality of receiving means for cooperating with said internal coupling means;

means for receiving an end of the spindle; and, perimeter side support means and internal support means for supporting the load placed upon the assembly, said internal support means being an internal support structure comprising a first longitudinal support wall adjacent said second side wall, a second longitudinal support wall spaced apart and parallel to said first longitudinal support wall, and an arcuate support wall adjacent said second longitudinal support wall, each said internal support wall being integral with and projecting outwardly from said inner frame surface of only one said side section, whereby the internal and side support structures of each frame member compliment and strengthen the nonsupported other side section of each frame member when they are interconnected to one another, and whereby a spool member can be held between two pairs of interconnected frame members by engaging each end of the spindle into said spindle receiving means and by encircling the entire assembly with tightened straps.

2. A unit load assembly for spools as described in claim 1, wherein said receiving means for cooperating with said internal coupling means is a plurality of spaced connector openings in each said frame member which are positioned to be vertically aligned with said spaced connector opening of the interconnected frame member.

3. A unit load assembly for spools as described in claim 1, wherein the spacing between said frame members define forklift tine-receiving slots.

4. A unit load assembly for spools as described in claim 1, wherein said spindle receiving means is at least one central aperture in each said frame member which is positioned to be vertically aligned with said central aperture of the interconnected frame member.

5. A unit load assembly for holding a spool member having windings wrapped around a spindle, the spindle having ends extending out beyond the edge of the windings, comprising:

a pair of frame members interconnected to one another by a plurality of internal coupling means, said internal coupling means spacing said frame members from each other, each frame member having opposed end walls, opposed side walls, an outer frame surface and an inner frame surface, each frame member further including:

a plurality of receiving means for cooperating with said internal coupling means;

means for receiving an end of the spindle; and, perimeter side support means and internal support means for supporting the load placed upon the assembly, said perimeter side support means being a second side wall having a plurality of integral posts, both projecting outwardly from and integral with said inner frame surface, whereby a spool member can be held between two pairs of interconnected frame members by engaging each end of the spindle into said spindle receiving means and by encircling the entire assembly with tightened straps.

6. A unit load assembly for spools as described in claim 1 further comprising channel means within said end walls for receiving a tightened strip therein.

7. A unit load assembly for spools as described in claim 6, wherein the channel means is a strap channel disposed within said end wall.

8. A unit load assembly for spools as described in claim 7, further comprising a strap channel disposed within said outer frame surface, a strap channel disposed within said first side wall, and a strap channel disposed within said second side wall, all said channels for receiving a tightened strap therein.

9. A unit load assembly for spools as described in claim 3, further comprising guidance means for aiding the forklift tines to enter the assembly.

10. A unit load assembly for spools as described in claim 9, Wherein said guidance means is an end wall having an inclined ramp section that tapers inwardly from said outer frame surface to said inner frame surface.

11. A unit load assembly for spools as described in claim 1, wherein said frame member coupling means is a plurality of connector members for releasably interconnecting said frame members.

12. A spool member holding unit load assembly comprising:

a spool member having windings wrapped around a spindle, the spindle having ends extending beyond the edge of the windings;

two pallet members, each said pallet member including a central aperture therein for receiving one end of the spindle, said spool member being disposed between said pallet members; and, at least one strap encircling the entire assembly, said strap being tightened;

each said pallet member having forklift tine receiving slots therein and being a pair of substantially identical frame members releasably interconnected, each said frame member including two approximately equal side sections, opposed end and side walls, an outer frame surface and an inner frame surface, a plurality of spaced connector openings and at least one central aperture therein, each said connector opening and said central aperture positioned to be vertically aligned with each said interconnected frame member connector openings and said central aperture, and, a perimeter support structure and an internal support structure integral with and projecting outwardly from said inner frame surface, said internal support structure projecting outwardly from said inner frame surface of only one said side section and including a first longitudinal support wall and a spaced, parallel second longitudinal support wall connected to an arcuate support wall, said longitudinal support walls extending generally from one end to said opposed end, said arcuate support wall being generally semi-circular and positioned adjacent the perimeter of said central aperture, whereby the internal and side support structures of each frame member compliment and strengthen the nonsupported other side section of each frame member when they are interconnected to one another; and, a plurality of connector members for releasably coupling said frame members.

13. A spool member holding unit load assembly comprising:

a spool member having windings wrapped around a spindle, the spindle having ends extending beyond the edge of the windings;

two pallet members, each said pallet member including a central aperture within for receiving one end of the spindle, said spool member being disposed between said pallet members; and, at least one strap encircling the entire assembly, said strap being tightened;

each said pallet member having forklift tine receiving slots therein and being a pair of substantially identical frame members releasably interconnected, each said frame member including opposed end and side walls, an outer frame surface and an inner frame surface, a plurality of spaced connector openings and at least one central aperture therein, each said connector opening and said central aperture positioned to be vertically aligned with each said interconnected frame member connector openings and said central aperture, and, a perimeter support structure and an internal support structure integral with and projecting outwardly from said inner frame surface, said perimeter support structure being one side wall with integral posts which are higher than said opposed side wall; and, a plurality of connector members for releasably coupling said frame members.

14. A spool member holding unit load assembly as described in claim 13, wherein said first longitudinal support wall is connected to said higher side wall.

15. A spool member holding unit load assembly as described in claim 15, further comprising an inclined ramp section for guiding said forklift tine that tapers inwardly from said outer frame surface to said inner frame surface.

16. A spool member holding unit load assembly as described in claim 15, further comprising a strap channel disposed within said outer frame surface, said side walls and said end walls.

17. A unit load assembly for spools for holding a spool member having windings wrapped around a spindle, the spindle having ends extending beyond the edge of the windings, comprising:

a pair of substantially identical interconnected frame members, said frame members being interconnected by a plurality of connector members disposed therebetween for engagedly coupling with each said frame members, each said frame member having two approximately equal side sections, opposed end walls, opposed side walls, an outer frame surface and an inner frame surface and further including:

a plurality of spaced connector openings and a central aperture therein, each said openings and said aperture positioned to be vertically aligned with said interconnected frame member openings and aperture;

an end wall having an inclined ramp section that tapers inwardly from said outer frame surface towards said inner frame surface;

a side support structure; and, an internal support structure comprising a first longitudinal support wall connected to said side support structure, a second longitudinal support wall parallel to and spaced apart from said first longitudinal support wall and connected to an arcuate support wall, each said support wall being integral with and projecting outwardly from said inner frame surface of only one said side section, said side support structure, said longitudinal support walls extending generally from one end to said opposed end, said arcuate support wall being semi-circular and positioned adjacent the perimeter of said central aperture whereby the internal and side support structures of each frame member compliment and strengthen the nonsupported other side section of each frame member when they are interconnected to one another, and, said frame members being oriented so that each inner frame surface faces the other, each end walls align with the other end walls, each side support structure opposes the other side support structure, and being connected by said connector members engagedly disposed within the vertically-aligned connector openings of each frame member, whereby a spool member can be held in either a vertical position or a horizontal position between two pairs of interconnected frame members by threading one end of the spindle into said central aperture of one interconnected pair of frame members, by threading the other end of the spindle into said central aperture of the other interconnected pair of frame members, and by encircling the entire assembly with tightened straps.

18. A unit load assembly for spools as described in claim 17, further including at least one strap channel disposed within said outer frame surface, said side walls and said end walls.

* * * * *

UNITED STATES PATENT AND TRADEMARK OFFICE

CERTIFICATE OF CORRECTION

PATENT NO. : 5,097,951
DATED : March 24, 1992
INVENTOR(S) : Maurice J. Pigott et al.

It is certified that error appears in the above-indentified patent and that said Letters Patent is hereby corrected as shown below:

Column 9,

Claim 13, at patent line 27, after "central aperture" delete "within" and substitute --therein--.

Column 10,

Claim 17, at patent line 12, after "having" delete "two approximately equal side section,"; at patent line 32, delete "of only one"; at patent line 34, after "opposed end," insert --and --.

Signed and Sealed this

Seventh Day of December, 1993

Bruce Lehman

*Attest:*

BRUCE LEHMAN

*Attesting Officer*

*Commissioner of Patents and Trademarks*